US007166013B2

(12) United States Patent
Moriyama et al.

(10) Patent No.: US 7,166,013 B2
(45) Date of Patent: Jan. 23, 2007

(54) POLISHING APPARATUS AND METHOD FOR PRODUCING SEMICONDUCTORS USING THE APPARATUS

(75) Inventors: Shigeo Moriyama, Tama (JP); Yoshihiro Ishida, Hitachinaka (JP); Takashi Kugaya, Hitachinaka (JP); Shigeo Ootsuki, Kasama (JP); Soichi Katagiri, Kodaira (JP); Sadayuki Nishimura, Yokohama (JP); Ryosei Kawai, Kodaira (JP); Kan Yasui, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/004,991

(22) Filed: Dec. 7, 2004

(65) Prior Publication Data

US 2005/0095960 A1 May 5, 2005

Related U.S. Application Data

(63) Continuation of application No. 10/125,469, filed on Apr. 19, 2002, which is a continuation of application No. 09/462,912, filed as application No. PCT/JP98/04881 on Oct. 28, 1998.

(51) Int. Cl.

| | |
|---|---|
| ***B24B 49/00*** | (2006.01) |
| ***B24B 51/00*** | (2006.01) |
| *B24B 1/00* | (2006.01) |
| *B24B 29/00* | (2006.01) |

(52) U.S. Cl. ..... 451/5; 451/52; 451/289

(58) Field of Classification Search ..... 451/5, 451/41, 21, 56, 72, 451, 286–289, 52; 216/52
See application file for complete search history.

(56) References Cited

U.S. PATENT DOCUMENTS

| | | | | |
|---|---|---|---|---|
| 5,618,447 | A * | 4/1997 | Sandhu | 438/14 |
| 5,827,395 | A * | 10/1998 | Masumura et al. | 156/345.12 |
| 5,855,998 | A * | 1/1999 | Tanabe et al. | 428/216 |
| 6,120,347 | A * | 9/2000 | Sandhu et al. | 451/5 |

(Continued)

FOREIGN PATENT DOCUMENTS

| | | | |
|---|---|---|---|
| EP | 0 870 577 | A | 10/1998 |

(Continued)

*Primary Examiner*—Lee D. Wilson
*Assistant Examiner*—Alvin J. Grant
(74) *Attorney, Agent, or Firm*—Kenyon & Kenyon LLP

(57) ABSTRACT

The present invention relates to a polishing apparatus, and a semiconductor manufacturing method using the apparatus. Dressing of a grindstone surface is ground by sizing processing whereby dressing of a tool surface can be done while preventing occurrence of cracks on the grindstone surface which is the cause for occurrence of scratches. Further, flatness of the surface of a dressing tool can be guaranteed because of sizing cutting-in; even if a thick grindstone of a few centimeters is used, the flatness can be maintained to the end; and processing with less in-face unevenness can be always carried out. Therefore, the life of the dressing tool can be greatly extended.

Further, the present sizing-dressing is carried out jointly with processing of a wafer to thereby enable improvement of throughput of the apparatus as well as maintenance of a processing rate.

The present apparatus and method are effective for planarization of various substrate surfaces having irregularities.

6 Claims, 8 Drawing Sheets

U.S. PATENT DOCUMENTS

| | | | | |
|---|---|---|---|---|
| 6,180,020 | B1 * | 1/2001 | Moriyama et al. | 216/88 |
| 6,432,825 | B1 * | 8/2002 | Torii | 438/692 |
| 6,478,977 | B1 | 11/2002 | Moriyama et al. | |
| 6,524,961 | B1 * | 2/2003 | Katagiri et al. | 438/691 |

FOREIGN PATENT DOCUMENTS

| | | |
|---|---|---|
| JP | 59 161263 A | 1/1985 |
| JP | 63 084859 A | 8/1988 |
| JP | 02-256463 | 10/1990 |
| JP | 03-154777 | 7/1991 |
| JP | 07-009325 | 1/1995 |
| JP | 08-294861 | 11/1996 |
| JP | 08-323621 | 12/1996 |
| JP | 10-146750 | 6/1998 |
| JP | 10-180618 | 7/1998 |
| KR | 1998-016804 | 6/1998 |
| WO | WO 97/10613 | 3/1997 |
| WO | WO 97/10613 A | 3/1997 |

* cited by examiner

POLISHING APPARATUS AND METHOD FOR PRODUCING SEMICONDUCTORS USING THE APPARATUS

CROSS-REFERENCE TO RELATED APPLICATION

This is a continuation of U.S. application Ser. No. 10/125,469, filed on Apr. 19, 2002, which is a continuation of Ser. No. 09/462,912, filed on Oct. 28, 1998, which is a National Stage Application of PCT/JP98/04881, filed on Oct. 28, 1998, the disclosures of which, in their entirety, are hereby incorporated by reference.

FIELD OF THE INVENTION

The present invention relates to a planarization technique for a wafer surface pattern by polishing processing used in the process of manufacturing a semiconductor integrated circuit, and particularly, to a processing method for the planarizing with high accuracy, high efficiency, and inexpensively without occurrence of processing damage, and a processing apparatus therefor.

BACKGROUND OF THE INVENTION

Recently, a process of laminating multi-layers of a semiconductor device is becoming important with the trend of higher processing speed and fine patterns of a semiconductor device. With the progress of the multi-layer wiring technique, there has been posed a problem of irregularities formed on the surface of a sample. For example, in the case where a circuit pattern is formed on the sample surface by an optical exposure device (hereinafter referred to as a stepper), it is necessary to accurately adjust the focal point of the stepper onto the sample surface. However, when the irregularities are present on the sample surface, adjustment of the focal point on the sample surface is difficult, resulting in an occurrence of serious problem of inferior resolution.

For overcoming such an inconvenience as described above, the technique for planarizing the surface of a semiconductor device has been demanded.

In Japanese Patent Laid-open No. Hei 10-146750, there is disclosed a technique for planarizing the fine irregularities formed on the surface of a semiconductor device. According to the technique disclosed in the publication, a wafer substrate to be processed held on a rotating holder is pressed on the surface of a polishing pad held on a rotating table, and a polishing liquid containing loose abrasive grain is supplied between the polishing pad and the wafer to be processed, whereby the surface of the semiconductor wafer substrate can be polished to planarize the fine irregularities.

Since the polishing pad used for the purpose of polishing as described above becomes crushed in surface as it is used, dressing is carried out therefor with suitable frequency Dressing termed herein is that a polishing pad is shaved by a diamond grindstone (hereinafter referred to as a dressing tool) or the like for dressing to provide a suitable surface roughness, as disclosed in Japanese Patent Laid-open No. Hei 10-180618.

DISCLOSURE OF INVENTION

Dressing of a polishing tool as described above is carried out by applying a fixed load to a grindstone to press it to the rotating polishing tool. However, the dressing carried out in the prior art as described above is merely to realize formation of a surface roughness of the polishing tool.

On the other hand, if an attempt is made to prolong the service life of the polishing tool, it is necessary to thicken or harden the polishing tool. However, there has occurred another problem as the hardness of the polishing tool increases, which has not occurred in the prior art.

The present invention has been achieved in order to solve the problem as noted above.

According to the present invention, there is provided a polishing apparatus which applies relative motion between a workpiece and a polishing tool to polish the surface of the workpiece by the polishing surface of the polishing tool, comprising: a dressing tool for forming a surface roughness on the polishing surface of the polishing tool; a first moving means for applying relative motion between a grindstone and the polishing tool; a second moving means for moving the dressing tool relatively in a direction vertical to the polishing surface of the polishing tool to locate it to a desired position; and a control means for permitting the execution of the movement caused by the first moving means while controlling the position of the second moving means.

BEST MODE FOR CARRYING OUT THE INVENTION

The embodiments of the present invention will be described hereinafter with reference to the drawings.

The semiconductor manufacturing step comprises many processing steps. First, the wiring step which is one example of the steps to which the present invention is applied will be described with reference to FIG. 1.

Figure 1A:
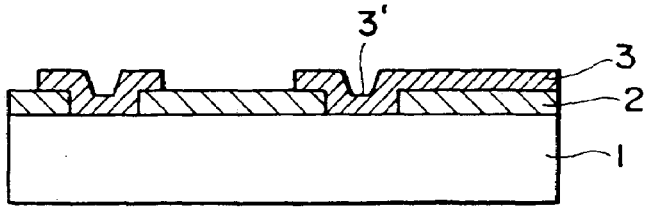
FIG. 1 is an explanatory view of the planarization step for the wafer surface.

FIG. 1A is a sectional view of a wafer formed with wiring of a first layer. An insulating film 2 is formed on the surface of a wafer substrate 1 formed with a transistor portion on which a wiring layer 3 such as aluminum is provided. Since the insulating film 2 is provided with a hole in order to form a junction between the wafer substrate 1 and wiring layer 3, portion 3' of the wiring layer is somewhat depressed.

Figure 1B:
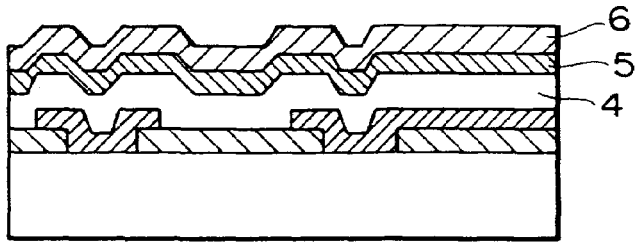

In the wiring step of a second layer shown in FIG. 1B, an insulating film 4 and a metallic aluminum layer 5 are formed on the first layer, and a photoresist layer 6 for exposure is adhered thereto for wiring-patterning the aluminum layer.

Figure 1C:
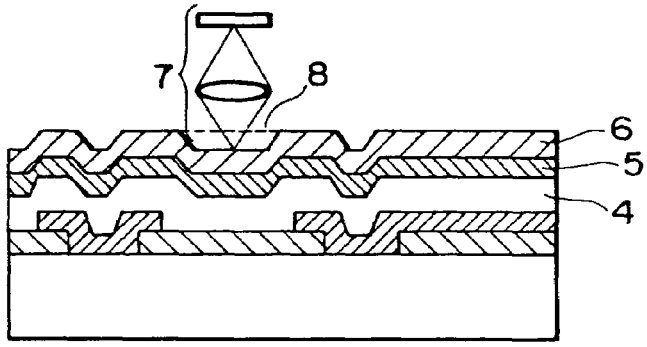

Next, as shown in FIG. 1C, a circuit pattern is transferred in exposure on the photoresist 6 using a stepper 7. In this case, when the surface of the photoresist layer 6 has irreguralities, focusing is not obtained on a concave portion and a convex portion 8 on the photoresist surface simultaneously as shown, resulting in an importance obstacle or inferior resolution.

Figure 1D:
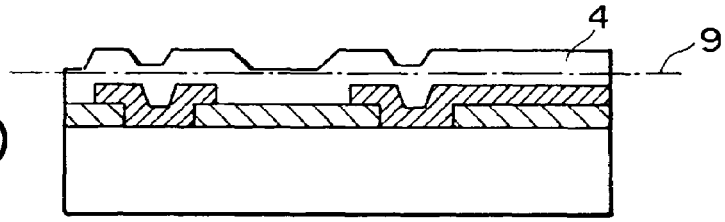
Figure 1E:
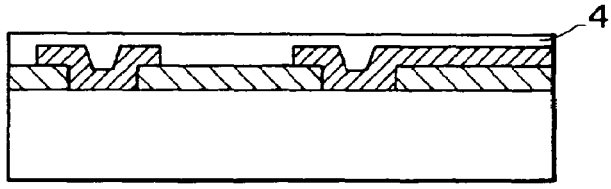
Figure 1F:
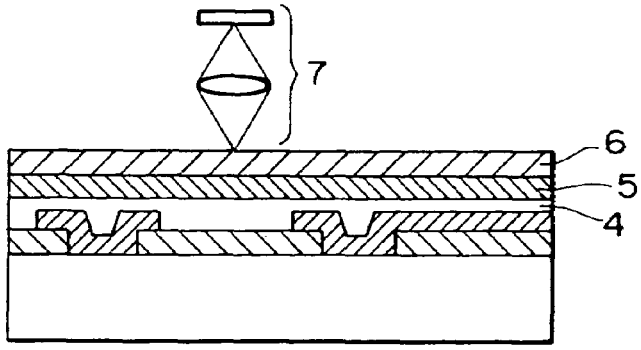

For overcoming such an inconvenience as described, planarization processing for the substrate surface is carried out as mentioned below. After the processing step shown in FIG. 1A, an insulating layer 4 is formed, as shown in FIG. 1D, after which polishing processing is carried out by a method described later so as to be planar to a level 9 shown to obtain a state shown in FIG. 1E. Thereafter, a metallic aluminum layer 5 and a photoresist layer 6 are formed, and exposed by a stepper as shown in FIG. 1F. Since in this state, the photoresist surface is flat, no problem in the inferior resolution occurs.

In the following, an outline of the fixed abrasive grain processing apparatus suitable for employment of polishing processing according to the present invention will be explained while comparing with the chemical mechanical processing apparatus that has generally been used heretofore.

(1) Outline of Chemical Mechanical Polishing Apparatus

The surface planarizing apparatus for the semiconductor device surface as disclosed in Japanese Patent Laid-open No. Hei 10-180618 is called a chemical mechanical polishing (Chemical Mechanical Polishing: CMP) apparatus. As described above, in this apparatus, a polishing pad held on a rotating member is pressed against a semiconductor device held on a rotating sample table, and a liquid containing a polishing slurry is allowed to flow between the polishing pad and a sample to thereby polish and planarize the surface of the semiconductor device.

Figure 2:
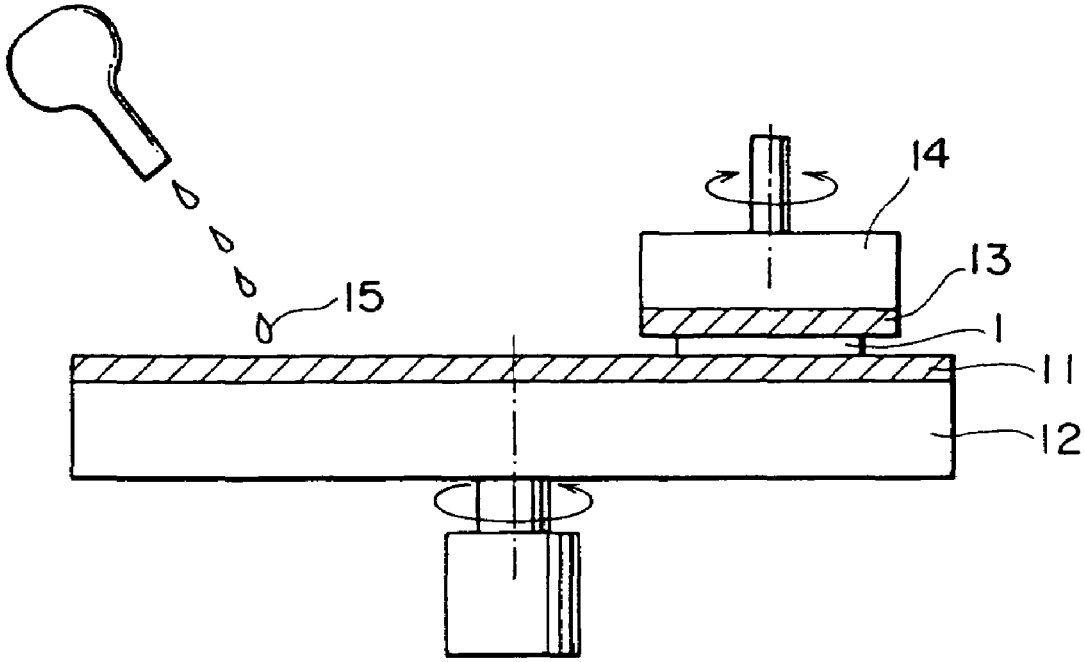
FIG. 2 is a view showing a chemical mechanical polishing method.

FIG. 2 is a view showing the principle of polishing a semiconductor device by a CMP apparatus. First, a polishing pad 11 is attached onto a surface plate 12 and remains rotated. This polishing pad is formed by slicing foamed urethane resin or the like into a thin sheet, and materials and fine surface construction thereof are variously selected and used according to kinds of workpieces and a degree of surface roughness suited to finishing.

A wafer to be processed (a semiconductor device) 1 is fixed to a wafer holder 14 through an elastic keeping pad 13. The wafer holder 14 being rotated is loaded on the surface of the polishing pad 11, and polishing slurry 15 is supplied onto the polishing pad 11 to thereby polish and remove a convex portion of an insulating film 4 on the wafer surface to planarize it.

As described above, the CMP is a method for carrying out processing while supplying the polishing slurry between the polishing pad and the workpiece, which method is extensively known as loose abrasive grain polishing technique but has three great problems noted below.

A first problem is dependence on pattern dimension, that is, it may be impossible to be sufficiently planarized depending on kinds of patterns or a state of level difference. Generally, a pattern on the semiconductor wafer is formed from a pattern having various dimensions and level difference.

Figure 3A:
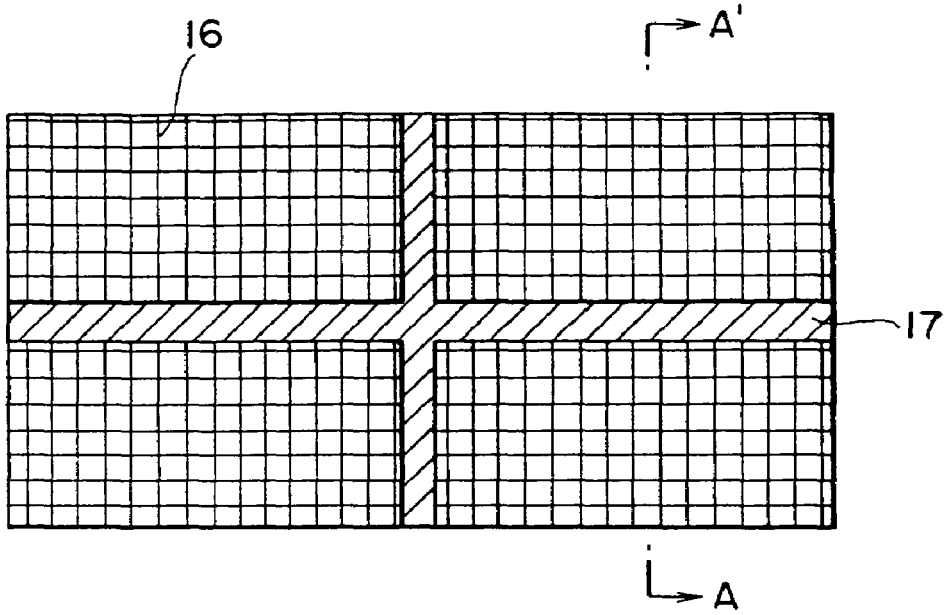
FIG. 3 is a view showing a plane and a section of a semiconductor memory element.

For example, as for an example of a semiconductor memory element, a chip is divided into four blocks, as shown in FIG. 3A. The four blocks are internally formed with fine memory cells which are regularly and closely arranged, which is called a memory mat portion 16.

Figure 3B:
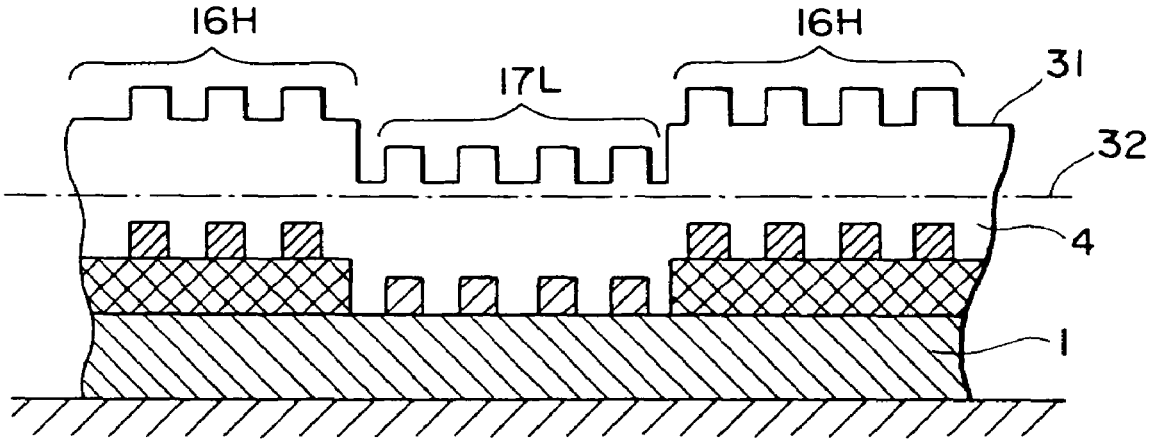

In a boundary between the four memory mat portions is formed a peripheral circuit 17 for getting access to the memory cells. In case of a typical dynamic memory, a dimension of one chip is approximately 7 mm×20 mm, and width of the peripheral circuit portion is approximately 1 mm. In section A–A' of the chip, average height of the memory mat portion 16 is higher by approximately 0.5 to 1 μm than that of the peripheral circuit portion 17, as shown in FIG. 3B. When an insulating film 4 having thickness of approximately 1 to 2 μm is formed on such level difference pattern, a sectional shape 31 of the surface portion also substantially reflects a level difference shape of the base pattern.

Figure 4:
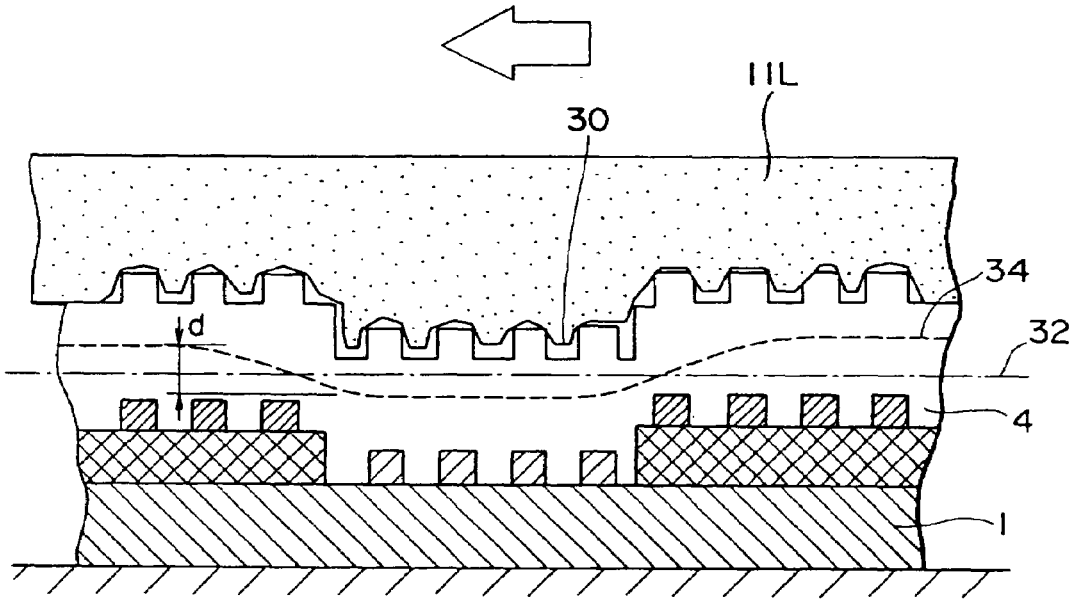
FIG. 4 is a view showing a problem when processing is accomplished using a soft polishing pad.

In the planarization step for a semiconductor wafer, the insulating film 4 on the wafer surface is to be planarized as indicated by dotted lines 32. However, generally, where a soft polishing pad 11L made of foamed urethane resin which is often used for the aforesaid use is used, planarizing as described above cannot be achieved as the polishing speed depends on a pattern. That is, where the soft polishing pad 11L is used as shown in FIG. 4, a surface shape of the polishing pad is deformed as indicated by the solid line in the figure due to the polishing load. In a fine pattern whose dimension is in micrometers order, a load is concentrated thereon, and planarization polishing is done in a short period of time, whereas in a fine pattern whose dimension is in a few milimeters order, a load is applied as a distributed load so that polishing speed is low. As a result, a sectional shape after polishing is as indicated by wave lines 34 in FIG. 4 so that height difference d still remains.

For use of the wiring step of a semiconductor, unevenness ±5% or less is desired, and an upper limit of hardness of the polishing pad is approximately Young's modulus: 10 $kg/mm^2$.

Therefore, in semiconductor elements in which various patterns from a few milimeters order to micrometers order are mixed as in a memory element, sufficient planarization effect cannot be expected. Applicable objects are limited to semiconductor products including a pattern not being excessively large size, for example, such as a logic LSI.

A second problem in the planarization technique of a loose abrasive grain system is that running cost is high. This results from low utilization efficiency of the polishing slurry in the loose abrasive grain polishing method. That is, it is necessary for super-smooth polishing free from occurrence of polishing scratch to supply polishing slurry such as colloidal silica in a rate of hundreds cc/min or more, most of which are however removed without contribution to actual processing.

The price of high-purity slurry for a semiconductor is very high, and most of cost for the planarization polishing process is determined by quantity of using the polishing slurry, improvement of which is therefore strongly demanded.

A third problem is that the life of a polishing pad is short, which results from dressing work for the surface of the polishing pad. At present, it is necessary to replace a polishing pad every 500 wafers.

(2) Outline of Fixed Abrasive Grain Polishing Apparatus

For solving the problem with respect to the loose abrasive grain polishing as described above, there is a polishing method by means of the fixed abrasive grain polishing employed in an apparatus of an embodiment of the present invention.

The fixed abrasive grain polishing technique employed in the apparatus of the embodiment of the present invention uses, in the polishing apparatus shown in FIG. 2, a special grindstone 20 whose hardness is controlled optimally in place of the conventional polishing pad.

More specifically, elastic modulus of the grindstone 20 is 5 to 500 $kg/mm^2$, and the hardness thereof is 1/10 to 1/100 of that of a conventional grindstone that has been used in other fields. On the other hand, the hardness of the grindstone 20 is 5 to 50 times that of a hard polishing pad such as hard foamed polyurethane that has been used for the present invention.

Figure 5:
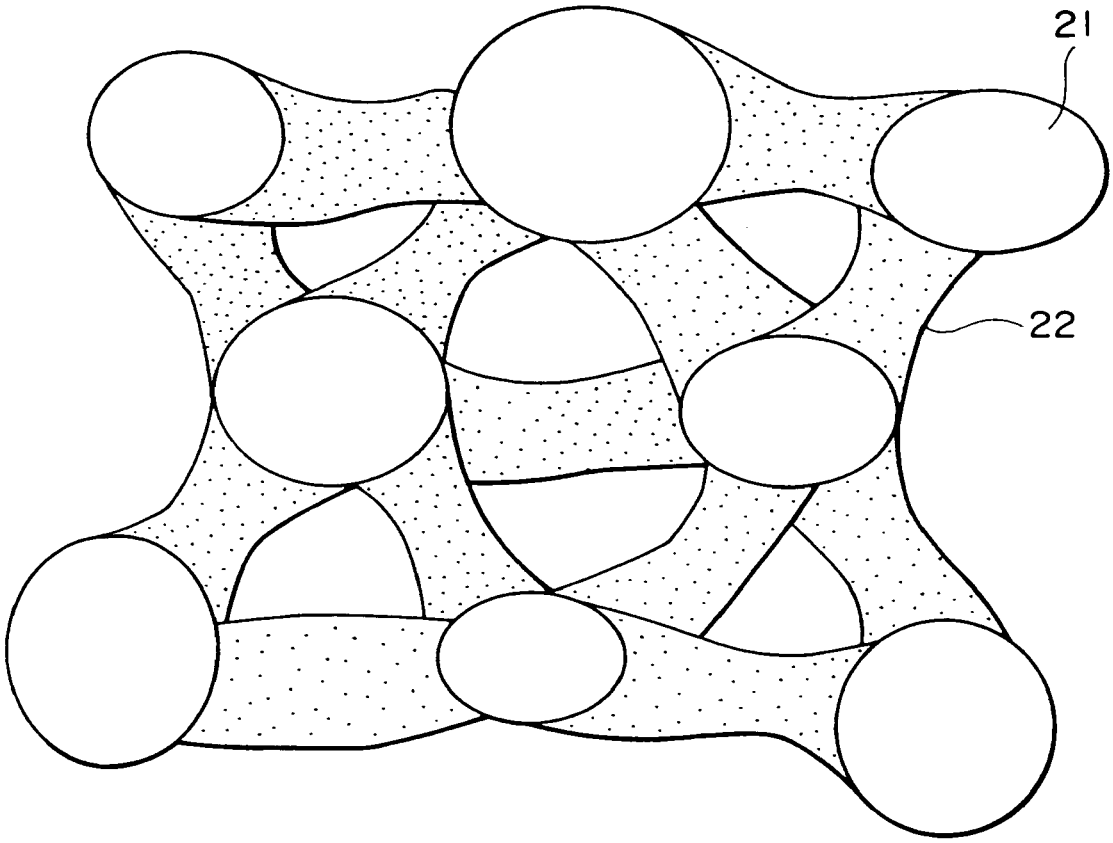
FIG. 5 is a view showing the constitution of a grindstone used in fixed abrasive grain processing method.

FIG. 5 shows the construction of a grindstone used in the aforementioned technique. Abrasive grain 21 is preferably formed of silicon dioxide, cerium oxide, aluminum oxide, etc., and if grain size thereof is approximately 0.01 to 1 μm, excellent processing efficiency can be obtained without occurrence of scratches.

It is said to be preferable that resin 22 for joining the abrasive grain is high purity organic resins of a phenol family, a polyester family or the like. The abrasive grain is mixed into the joining resin, after which proper pressure is applied thereto to solidify it, and processing such as heating and hardening is applied as necessary. In the aforesaid process, hardness of the grindstone resulting from the kind of the joining resin and the magnitude of pressurization can be controlled, and in the present art, this is to be 5 to 500 $kg/mm^2$.

In the case where pure water as polishing liquid is supplied to a grindstone fabricated by joining the cerium oxide abrasive grain having 1 μm of grain size with the phenol family or polyester family resin so that elastic modulus is 100 $kg/mm^2$, which is used to process a silicon dioxide film having a 1 μm of thickness. In this case, no scratch occurs, and there can be obtained extremely excellent planarization performance, which processing speed is 0.3±0.011 μm or less with respect to all kinds of patterns whose pattern width is from 10 mm to 0.5 μm.

Coexistence of the scratch-free processing and the excellent planarization performance can be achieved first by the fixed abrasive grain processing using the grindstone whose elastic modulus is optimized.

Further, in the loose abrasive grain processing, the polishing pad has a life of approximately 500 wafers. However, in the above-described art, the thickness of the grindstone can be a few centimeters, and therefore, the life of the grindstone can be extended, which ends to approximately 15000 wafers.

This means that the frequency of replacing a polishing pad can be reduced to "from every day to every month", i.e., 1/30, which is an extremely great merit in a site in which products are made in a large volumes.

The planarization method using the aforementioned grindstone as a polishing tool has many merits, but it has been found that new problems occur because of the fixed abrasive grain processing.

A first problem is a problem of maintaining processing efficiency of the grindstone surface. Also in the planarization technique using the above grindstone, similar to the planarization polishing by way of loose abrasive grain, blinding occurs in the grindstone surface as wafers are polished, and dressing for the grindstone surface is sometimes necessary. For this dressing, scratching processing by way of constant pressure load has been used heretofore.

Figure 6:
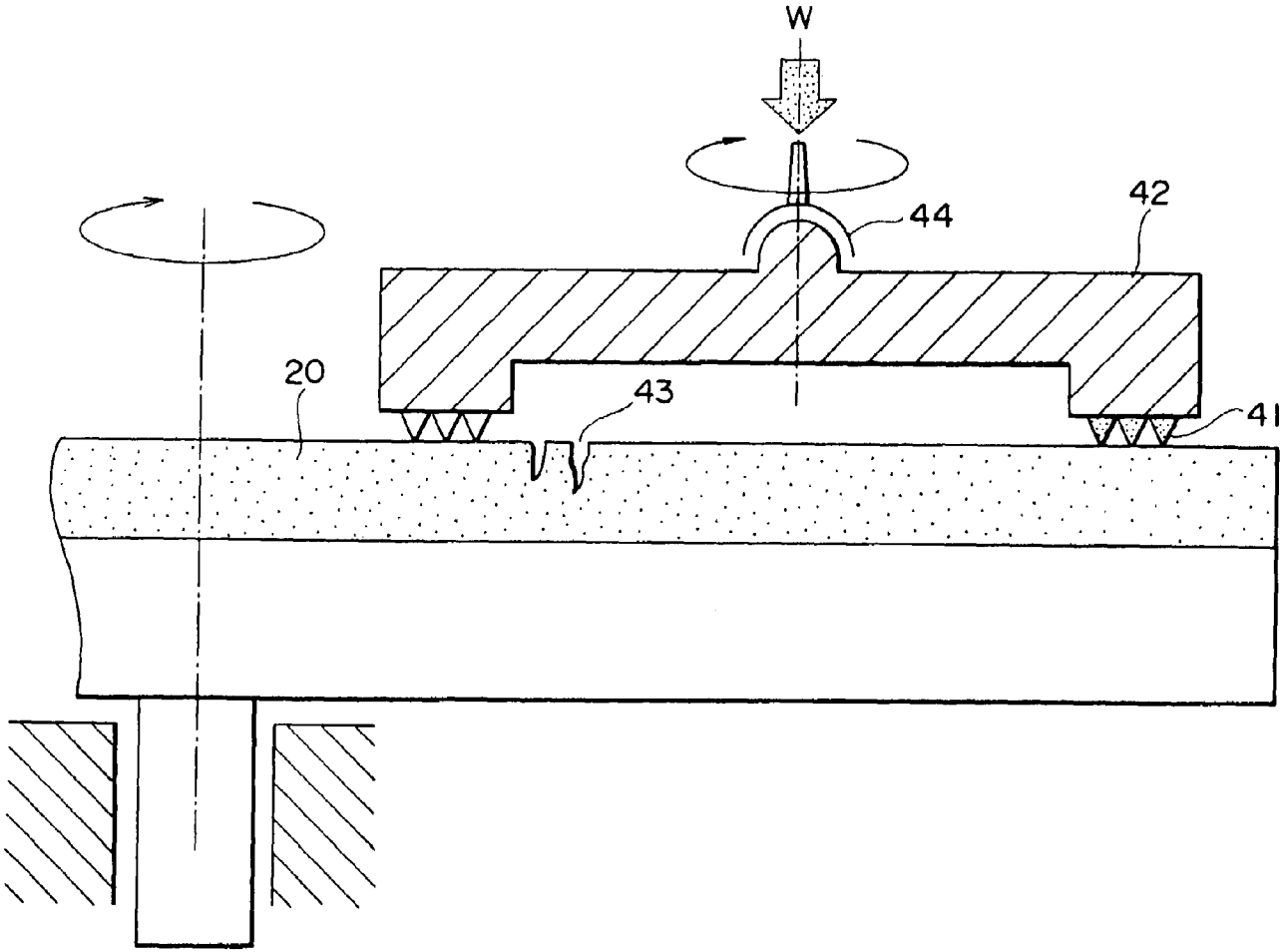
FIG. 6 is a view showing a conventional dressing method in the fixed abrasive grain processing method.

Specifically, as shown in FIG. 6, a conditioning ring 42 with diamond grain 41 from #80 to #400 embedded is slidably moved at relative speed from 5 to 30 cm/s on the surface of a grindstone 20 while loading under average surface pressure from about 100 to 300 $g/cm^2$. Thereby, the edge of the diamond grain 41 uniformly scratches the grindstone surface, thus enabling carrying out dressing for the grindstone surface.

However, it has been found that when the surface of a grindstone is subjected to dressing, similar to the polishing pad of the CMP, sharp cracks 43 having depth of a few tens of micrometers occur on the grindstone surface, and the crack end triggers breakage of the grindstone end during the polishing processing, finally leading to occurrence of large cracks in micrometers order. It is supposed that the occurrence of cracks results from the fact that the size of the diamond grain 41 is large, such as #80 to #400, that is, grain size: 300 μm to 60 μm. Further, this abuse also results from the fact that the hardness of the wafer polishing grindstone 20 is high.

So, if the diamond grain size is made smaller, this problem can be solved. However, there occurs a further serious problem in this case. That is, it becomes difficult to adhere the diamond grain 41 to the base ring 42 so that the diamond grain is disengaged during the dressing operation and embedded into the grindstone surface, resulting in occurrence of scratches.

The phenomenon of occurrence of cracks on the surface of a polishing tool is a unique phenomenon occurring only at the time of dressing of a grindstone whose mechanical property is adjusted to be used for planarization of a semiconductor, and such a phenomenon as described has not occurred at the time of dressing a polishing pad formed of a polyurethane resin or the like which is a ductile material.

A second problem is deterioration of a planarization degree of the grindstone surface. A conventional general dressing method is based on the processing principle of scratching diamond grain while pressing them into the grindstone surface under a constant load, and has its object to apply a constant load to a conditioning ring irrespective of change in height or inclined attitude of the grindstone surface to create a uniform surface roughness.

To this end, generally, it is constructed that as shown in FIG. 6, a constant pressure load by way of an air cylinder or the like is applied to a conditioning ring 42 through a gimbals support 44. Therefore, where hardness distribution of the grindstone is uneven or the number of revolutions of the conditioning ring is deviated from a set value, dressing amount distribution in a radial direction of the grindstone is uneven so that about the time when the grindstone having approximately 20 mm of initial thickness is dressed to approximately 10 mm of thickness, a shape of the grindstone surface is formed into a shallow cone-shape or an inverted Mt. Fuji shape in tens of micrometers order. When the flatness of the grindstone surface is deteriorated as described, processing unevenness occurs in the wafer surface to be processed, resulting in an important defect.

If an attempt is made to obtain processing evenness of 5% with the planarization by way of fixed abrasive grain processing, it is necessary that the flatness of the grindstone is in a few micrometers order.

The above-described problem of the flatness of the grindstone occurs also when a new grindstone is used. That is, it is very difficult for a large grindstone having a diameter of 70 cm or more and a thickness of a few centimeters to fabricate in a few micrometers order of the flatness of the surface to be polished and to mount on the polishing apparatus, and the inferior flatness at that time was impossible to be corrected by a conventional constant pressure dressing method. Further, in the case where the grindstone is divided into a plurality of segments for the convenience of manufacture and mounting of the large grindstone, level difference, between the segments, in tens of micrometers order cannot be avoided, which also leads to a serious problem.

A problem in the flatness of the surface of the polishing tool as described above is a problem peculiar to the case where a grindstone having a thickness of a few centimeters is used, which could be almost ignored in a general polishing pad for loose abrasive grain processing in which elastic modulus of a pad material is soft such as 10 kg/mm$^2$ or less and thickness is thin such as approximately 1 mm.

Further, even where the flatness may pose a problem somewhat, it could be sufficiently dealt with by a simple correcting control such that the time for dressing convex portions on the surface of a polishing pad is slightly prolonged or loads are increased.

As explained so far, in the wafer planarization step by way of fixed abrasive grain processing, there poses many problems in the constant pressure dressing method used in the planarization step by way of a conventional general loose abrasive grain processing, and the solution for such problems is strongly desired.

(3) Outline of Apparatus According to Embodiment of the Present Invention

The apparatus according to an embodiment of the present invention is to solve the problem peculiar to the apparatus for polishing the surface of a semiconductor device by a hard polishing tool such as used for the aforementioned fixed abrasive grain processing. This will be explained hereinafter with reference to the drawings.

Figure 7:
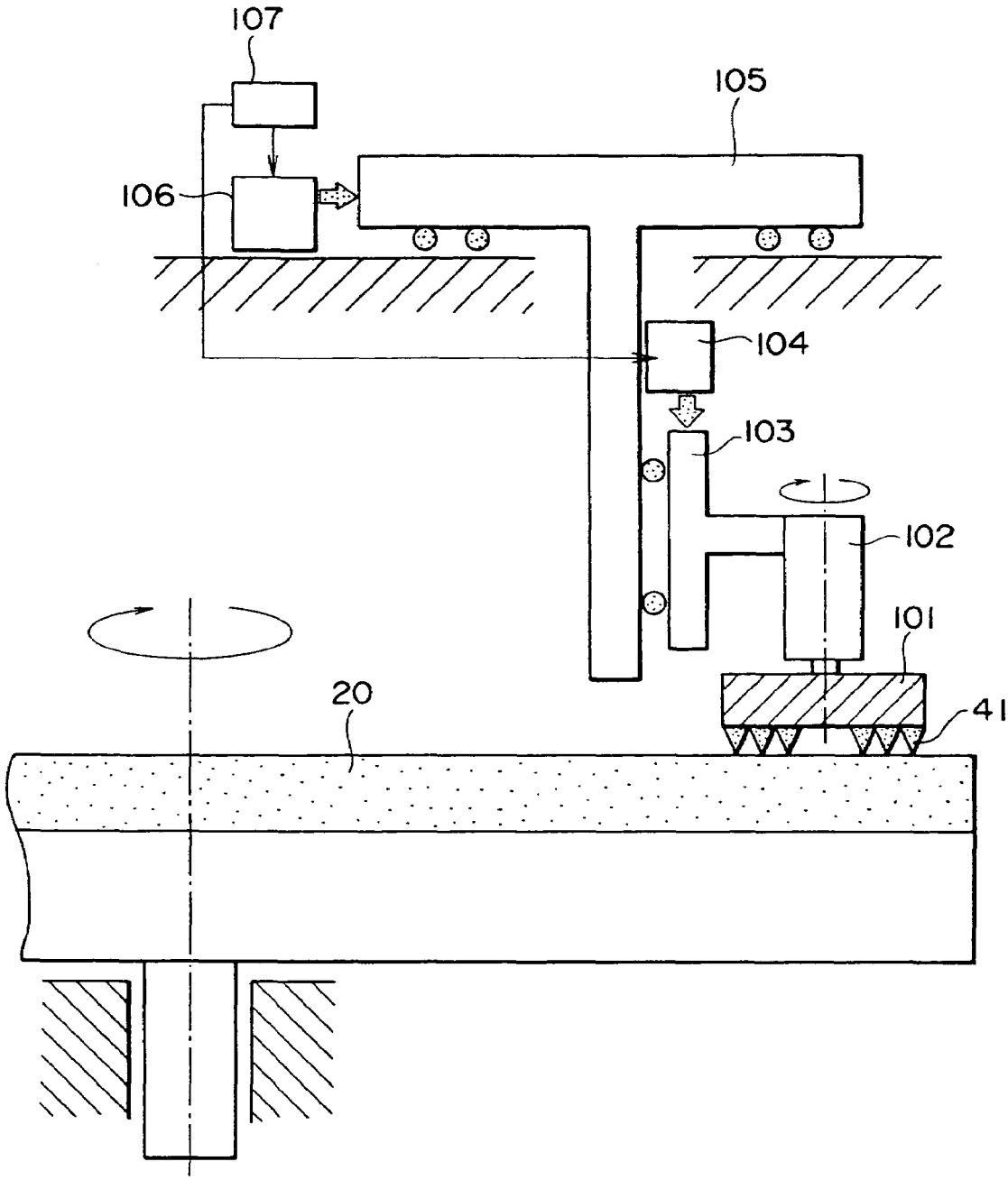
FIG. 7 is a view showing the dressing method according to the present invention.

FIG. 7 shows a concrete example for carrying out the present invention. In the drawing, a wafer holder for a wafer (a workpiece) which is an object to be polished is omitted.

A small diameter (50 mm) cup-shaped diamond grindstone 101 (a dressing tool) having diamond grain 41 of #100 fixedly mounted on the edge thereof is driven by a spindle motor 102 and rotates at high speed of 10000 rpm to apply dressing to a polishing surface of a wafer polishing grindstone 20 (a polishing tool) which rotates at speed of approximately 10 rpm. By the aforesaid high speed rotation, the peripheral speed of the diamond grindstone 101 reaches approximately 20 m/s to enable dressing of the grindstone surface with sufficiently small roughness.

In this case, the cut-in amount of the diamond grindstone 101 is in micrometers order, typically, 1 μm. The spindle motor 102 is provided on the Z moving table 103, and is driven by a Z driving system 104 (a second moving means) to move in a Z axis direction to enable positioning at a suitable position. Since the Z moving table 103 is controlled in movement in an X axis direction on an X moving table 105 to be moved in the X axis direction by means of an X moving system 106, the diamond grindstone 101 is moved straight in a radial direction of the grindstone while maintaining the cut-in amount (a position in the Z axis direction of the diamond grindstone) by the movement of the X moving table.

A rotating means for rotating the spindle motor 102, the X moving table 105 or the wafer polishing grindstone is to impart relative motion between the diamond grindstone 101 and the grindstone 20, and corresponds to a first moving means of the present invention. It is necessary that an error in motion of the shaft perpendicular to the moving shafts of these moving means is sufficiently small as compared with the cut-in amount.

The upper surface of the grindstone 20 is ground into an accurate plane by grinding the sample surface (hereinafter referred to as sizing-dressing) while maintaining the position of the Z axis direction of the diamond grindstone 101. In this case, the cut-in amount of the diamond grindstone 101 is determined by a positioning coordinate of the Z moving table 103 and is given by instructions of the control system 107.

While in the apparatus according to the embodiment of the present invention, a moving system for moving the diamond grindstone 101 in the Z direction, it is noted that the wafer polishing grindstone 20 may be moved in the Z direction so that a fixed cut-in amount will be maintained. Also, with respect to the movement in the X direction, the wafer polishing grindstone 20 may be moved.

The diamond grain 41 arranged and secured to the processing surface of the diamond grindstone 101 assumes a state of sticking into the wafer polishing grindstone 20 when the cut-in amount is set by the Z moving system 104. When in that state, the diamond grindstone 101 rotates, the diamond grain 41 grinds the surface of the wafer polishing grindstone 20 while maintaining the position of the Z direction thereof.

The surface processing for the wafer polishing grindstone constructed as described above is carried out in the following manner. First, prior to the wafer polishing, when an instruction for starting the dressing work is given, the polishing grindstone 20 starts to rotate. At the same time, the control device 107 gives the Z driving system an instruction of movement in the cut-in direction till the diamond grindstone 101 comes in contact with the grindstone surface. Note that elements (not shown) for detecting the aforesaid contact state may be any means, such as a contact type sensor, or a noncontact sensor such as an optical type, and the spindle motor 102 is preferably rotating.

When the contact therebetween is assured, the control device 107 gives an instruction of 1 μm of cut-in, and at the same time, gives the X-axis driving system 106 a continuous movement instruction at speed of approximately 10 mm/s. The X moving table 105 reciprocates by the distance one half diameter of the grindstone 20, and the diamond grindstone 101 grinds and removes the whole grindstone surface by 1 μm. Thereby, the grindstone surface is subjected to dressing. The times of reciprocation, moving speed and cut-in amount of the X moving table, and the rotational speed of the grindstone 20 are set to the optimal conditions while adjusting to the kind of grindstones. Preferably, pure water as processing liquid for grinding is supplied during the dressing work. Further, waste liquid and sludge remaining on the grindstone surface are preferably removed by vacuum attraction.

Preferably, setting of the times of reciprocation is decided on the basis of cut-in allowable depth capable of sticking the diamond grain 41 into the wafer polishing grindstone 20 (limit depth in which even if the extreme ends of the diamond grain 41 is stuck into the surface of the wafer polishing grindstone 20, the grindstone is not broken microscopically). For example, where the cut-in allowable depth is 0.5 μm, when the grindstone surface is desired to be removed by 1 μm by dressing, at least twice (one reciprocation) movements of the X moving table 105 is necessary.

As described above, where a large cut-in amount is desired to be obtained, it is suggested that stepwise control of position by the Z driving system 104 be carried out. For example, where cutting-in of 2 μm, cutting-in of 0.5 μm may be repeated four times for dressing. Such dressing work may be carried out in advance prior to processing of a workpiece, or may be carried out during processing together with processing. Particularly where dressing is carried out stepwise as described above, if dressing is carried out together with processing, throughput of apparatus is not impaired.

While in the foregoing, a description has been made of the case where in a state that a positioning coordinate of the Z moving table 103 be fixed, a dressing tool is X-moved to plane-process the surface of the polishing grindstone 20, it is to be noted that the positioning coordinate of the Z moving table 103 is numerical-controlled corresponding to the X coordinate of the X movement whereby the surface of the polishing grindstone 20 can be formed into a curve surface other than a plane.

In carrying out the present invention, to select the diamond grain 41 of the dressing tool is very important, and an excessively small or excessively large diamond grain 41 is not preferable. That is, while a dressing tool including lots of diamond grain having a small grain size is efficient because of many cutting edges, the diamond grain is liable to be disengaged due to cutting force, possibly resulting in the fatal cause of scratches. Conversely, in a dressing tool with less diamond grain having a large grain size, there is no possible disengagement of diamond grain. However, since the number of cutting edges is small, efficiency lowers unless the number of revolutions of the tool is increased.

While in the foregoing, the extreme ends of the diamond grain is sharp as in a point, it is to be noted that if the extreme ends are in the form of a flat edge, high efficiency can be obtained even if the number of diamond grain is small. Tool edges having a flat edge-like extreme end as described include a diamond cutting tool or a carbide cutting tool used in mirror-face grinding. Even a dressing tool of the type which rotates a detachable and small cutting tool as described at a high speed may provide good result.

According to the sizing-dressing of the apparatus of the present invention, dressing of the grindstone surface and planarization of the grindstone surface can be realized simultaneously, and adequate setting of the cut-in amount enables realization of dressing of a high hardness grindstone and planarization without occurrence of cracks in a wafer polishing grindstone.

The occurrence of cracks in the wafer polishing grindstone 20 in the present apparatus can be suppressed because the diamond grindstone 101 formed on the processing surface of the present apparatus with the diamond grain 41 performs polishing so as to scrape the circumference (the surface of the wafer polishing grindstone 20) in a state of maintaining the cut-in amount (depth) constant. That is, because, by adequate setting of the cut-in amount, the scratch-crushing force with respect to the wafer polishing grindstone 20 can be suppressed to a level below a fixed value against a microscopic construction change in the grindstone caused by the presence of pores or the like.

On the other hand, in the case of application of a polishing method by constant pressure load used so far, the diamond grindstone is pressed under constant pressure against the wafer polishing grindstone, generally. However, microscopically, discontinuous cut-in depth results due to the presence of pores or the like so that cracks sometimes occur by exceeding the allowable cut-in depth instantaneously.

As described in detail above, in the present apparatus of the present invention, even in the case where a high hardness grindstone as used in the fixed abrasive grain processing is employed, the problem as noted above can be overcome by fixing the wafer polishing grindstone and the relative position in the Z direction of the polishing tool.

Further, according to the sizing-dressing of the present invention, the planarization of the surface of the wafer polishing grindstone can be realized with higher accuracy as compared with the conventional polishing by the constant pressure load.

The polishing by the constant pressure load has a problem in that relatively fine undulation on the surface of the wafer polishing grindstone can be removed, but smooth undulation on the surface of the wafer polishing grindstone cannot be removed. This is because the diamond grindstone is moved so as to trace the smooth undulation of the wafer polishing grindstone merely by applying pressure. Particularly, in the apparatus in which the wafer polishing grindstone 20 is considerably larger in size than the diamond grindstone 101 shown in FIG. 7, it is contemplated for example that a convex portion (or a concave portion) wide in the hem occurs from end to end of the wafer polishing grindstone 20, which abuse sometimes becomes more notable.

On the other hand, in case of the sizing-dressing according to the present invention, the surface of the wafer polishing grindstone can be ground without being influenced by the irregularities of the surface of the wafer polishing grindstone, thus enabling planarization with high precision of the wafer polishing grindstone.

In applying the sizing-dressing, attention should be paid to the fact that excessive pressure is not applied to the wafer polishing grindstone. That is, attention should be paid to the fact that the wafer polishing grindstone is not pressed against the diamond grindstone under excessive pressure by setting the cut-in amount having excessive depth.

The control of the Z driving system by the element for detecting the contact state between the diamond grindstone and the wafer polishing grindstone, as described above, is carried out so that excessive pressure is not applied to the wafer polishing grindstone. Alternatively, a means (not shown) for detecting pressing force of the diamond grindstone may be provided in advance whereby when pressing force in excess of a fixed level is detected, the diamond grindstone is once moved away from the wafer polishing grindstone to generate an error or re-set a proper cut-in amount for carrying out polishing again.

There is another operating method which performs dressing simultaneously with planarization polishing of wafer. The operating method includes one mode in which the above operation carries out once during processing one wafer, and the other mode which always carries out dressing while increasing the cut-in amount continuously also during processing. For those requiring low-speed dressing according to the kind of grindstones, the latter mode is preferable.

It has been found after dressing of a grindstone whose abrasive grain is cerium oxide under the conditions of the aforementioned embodiment that cracks that occurred at a level of three per 10 $cm^2$ in the conventional method disappeared, and no scratch occurred.

Further, with respect to maintenance of the flatness of the processing surface of a grindstone, it is possible to obtain the flatness of 5 μm over the whole grindstone surface, which value has not been lowered even by about 5000 times of dressings, that is, by dressing till thickness of a grindstone reduces by 10 mm.

Further, it is contemplated that polishing by constant pressure load that has been used in the past and sizing-dressing are jointly used within a single apparatus. In this case, it is suggested that the polishing by a constant pressure load or the sizing-dressing can be selected depending on use of the wafer polishing grindstone or the polishing pad that has been used in the conventional CMP apparatus.

For example, in the apparatus shown in FIG. 7, it is suggested that the apparatus be set so that when a wafer polishing grindstone (or a polishing pad) is replaced, an operator inputs use of the wafer polishing grindstone or the polishing pad through an input unit not shown in FIG. 7 whereby whether the polishing by the constant pressure load or the sizing-dressing can be automatically selected.

Further, even a polishing pad that has been used in the conventional CMP, the sizing-dressing is sometimes suited depending on the hardness thereof. Therefore, it is contemplated that the apparatus is set so that whether the polishing by the constant pressure load or the sizing-dressing is automatically selected by inputting the kind of polishing tools.

By the constitution of the apparatus as described above, an operator is able to easily set the adequate polishing conditions without knowing the principle of polishing by the constant pressure load or the sizing-dressing.

Figure 8:
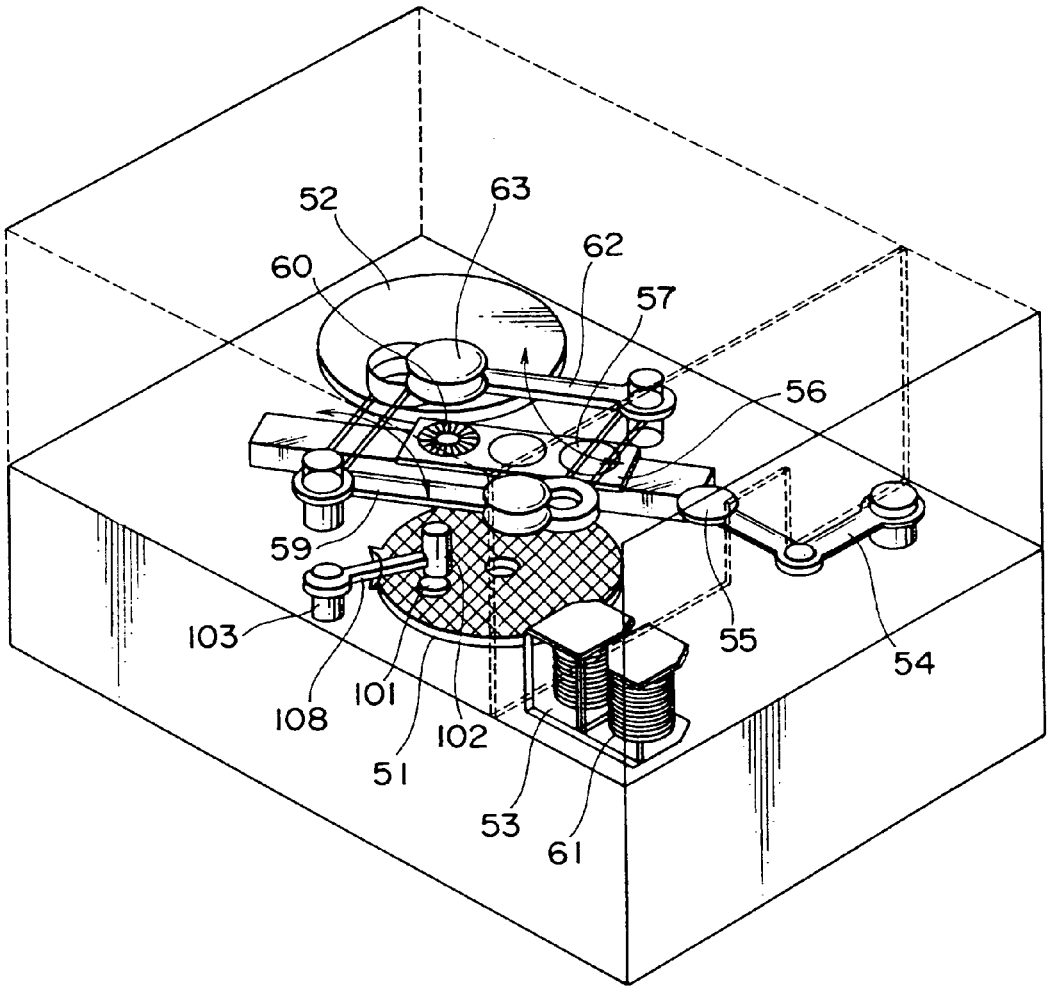
FIG. 8 is a view showing the construction of a processing apparatus suitable for carrying out the present invention.

Next, an example of a concrete constitution of a processing apparatus suitable for carrying out the present invention will be explained with reference to FIG. 8. Basically, this is a polishing apparatus comprising two platens and two heads, characterized in that a grindstone is used as a polishing tool, and that the art of the present invention for optimally dressing the grindstone is applied.

A grindstone which is high in planarization performance and is optimized in elastic modulus is adhered to the upper surface of a first grindstone surface plate 51, and a finishing grindstone which is low in elastic modulus is adhered to the upper surface of a second grindstone surface plate 52. These grindstone surface plates respectively polish a wafer while rotating at fixed speed of about 20 rpm.

Prior to processing, dressing of the first grindstone surface plate 51 is carried out. A spindle motor 102 mounted on the extreme end of an oscillating arm 108 causes a small-diameter diamond grindstone 101 to rotate at high speed of 10000 rpm, to dress the surface of the grindstone surface plate 51 which is rotating at 20 rpm. Setting of a cut-in amount is done by a Z moving device 103 at the base of the oscillating arm, typically, being cut in every 1 μm. An oscillating period of the arm is about 30 seconds, and when this is finished, wafer polishing is ready.

While in the above embodiment, the arm oscillating type is employed, it is apparent that the direct-operated type as shown in FIG. 7 may be employed. Further, while in the above embodiment, an example is described in which dressing is carried out prior to processing of planarization polishing. It is noted that this can be carried out during processing as previously mentioned.

When dressing is finished, the step enters polishing of a wafer. A wafer 55 to be processed is taken out of a loader cassette 53 by a handling robot 54 and is put on a load ring 57 on a direct-operated carrier 56. When the direct-operated carrier 56 moves leftward in the figure and is positioned at a load/unload position, a polishing arm A58 rotatively moves. The wafer 55 to be processed is then vacuum-adsorbed on the lower surface of a wafer polishing holder 59 provided on the extreme end thereof. Then, the polishing arm A58 rotates so that the wafer polishing holder 59 may position on the first grindstone surface plate 51. The wafer polishing holder 59 presses the wafer 55 to be processed being adsorbed on the lower surface against the grindstone to process it while rotating. When the first processing step is finished, the polishing arm A58 then rotates so that the wafer polishing holder 59 may position on the second grindstone surface plate 52. Thereafter, the wafer polishing holder 59 rotates while pressing the wafer 55 to be processed being adsorbed on the lower surface against the second grindstone surface plate 52 to finish it.

Upon termination of the aforementioned two stages, the step enters next cleaning step. The polishing arm A58 rotates to position the wafer polishing holder 59 on a cleaning position on which a rotational brush 60 is provided.

The rotational brush 60 washes the processing surface of the wafer 55 to be processed being adsorbed on the lower surface of the wafer polishing holder 59 by a washing brush while rotating. Upon completion of cleaning, the direct-operated carrier 56 again moves to the cleaning position to receive the wafer to be processed released from the vacuum adsorption of the wafer polishing holder 59. While here, the rotational brush is used, it is to be noted that a cleaning method by way of a jet water flow with supersonic waves can be used instead. Thereafter, when the direct-operated carrier 56 returns to the load/unload position, the wafer handling robot 54 grips a processed wafer, which is housed in an unload cassette 61.

One period of operation for the polishing arm A58 has been described above. A polishing arm B62 is also jointly operated similarly to the former. Naturally, this is because two polishing surface plates are time-divided for effective utilization. The operating sequence of the polishing arm B62 is exactly the same as that of the polishing arm A58, but a phase is delayed only by one half period. That is, the polishing arm B62 starts its operation while adjusting to the start of the second polishing step.

The above-described embodiment is an example of constitution suitable for the case where the number of polishing arms is two, and the dressing apparatus is only one system. This is the constitution in which there is provided a position where rotating traces of two polishing arms cross or are in contact, and there is provided a stop position for a pair of cleaning brushes and the direct-operated carrier for the load/unload, whereby these functions are jointly used by the two polishing arms.

While in the above-described embodiment, only the first polishing surface plate is proved for dressing, a rotating center position of the dressing apparatus can be changed as necessary so that the second polishing surface plate can be dressed, or a second dressing apparatus can be separately provided.

While a description has been made of the embodiment in which two polishing arms are provided, it is to be noted that naturally, a single arm will suffice for simplifying the constitution. Conversely, for improving the throughput of the apparatus, the number of polishing arms can be made three or more, or a plurality of wafer polishing holders can be mounted on a single polishing arm.

Further, while in the above-described embodiment, two rotating surface plates are respectively independently provided for the polishing pad and for the grindstone, it is to be noted that a single rotating surface plate will also suffice. That is, a ring-like grindstone is provided in the peripheral portion of the rotating surface plate, and a finishing grindstone is provided in the central portion thereof.

Further, a polishing grindstone or a polishing pad mounted on the polishing surface plate is not always limited to an integral disk-like form, but a combination of a plurality of segments may be used. Alternatively, it can be designed so that a rotating surface plate is inclined in order to make a foot pint (a projection area for installation) of apparatus small.

Further, the apparatus of the present invention can be applied to the manufacture of optical elements having a fine surface construction such as a semiconductor element, a liquid crystal display element, a micro machine, a magnetic disk substrate, an optical disk substrate, a Fresnel lens and so on.

In the case where a semiconductor wafer is planarized by the fixed abrasive grain processing method using a grindstone as a polishing tool, dressing of the grindstone surface is carried out by sizing-dressing method of cutting-in in micrometers order, and therefore, occurrence of cracks on the grindstone surface which is the cause of occurrence of scratches can be prevented.

Further, in this case, flatness of the grindstone surface is always guaranteed because of the sizing cut-in, and polishing processing without occurrence of unevenness can be always carried out. As a result, further, thickness of a grindstone can be a few centimeters or more, enabling to greatly extend the life of grindstone.

Further, by continuously carrying out application of sizing-dressing to a grindstone of the present invention also during wafer processing, clogging during processing can be prevented, and the overhead time necessary for dressing can be eliminated, thus enabling improvement of throughput of apparatus.

While in the above description of the embodiment of the present invention, an example using a grindstone by way of the fixed abrasive grain polishing method has been described, it can be readily imagined that even if that is applied to a polishing pad used in the conventional CMP apparatus, substantially similar effect can be obtained. In this case, the effect of the present invention can be enjoyed to the maximum by using a (hard) polishing pad which is thicker and is larger in elastic modulus as compared with a prior art.

Furthermore, since in the apparatus of the present invention, planarization of a polishing tool and dressing can be carried out simultaneously, it is possible to improve the throughput of apparatus.

Moreover, while in the foregoing, an embodiment in connection with a semiconductor wafer has been described, this can be also applied to planarization processing of others such as a thin film video device, substrates formed of glass or ceramics, etc.

Further, in the present invention, the throughput of apparatus as well as maintenance of processing rate can be improved by jointly carrying out the wafer processing and the sizing-dressing.

According to the present invention, also in the fixed abrasive grain processing method using a grindstone, occurrence of cracks can be prevented to dress the grindstone surface, and planarization processing without occurrence of scratches can be carried out. Further, the flatness of the grindstone surface can be guaranteed because of the sizing cut-in, and processing without in-face unevenness can be always carried out. Therefore, a thick grindstone of a few centimeters can be used, enabling greatly extending of the life of a grindstone.

Furthermore, in the present invention, the present sizing-dressing is carried out jointly with the wafer processing to thereby improve the throughput of apparatus as well as maintenance of processing rate.

What is claimed is:

1. A method for manufacturing a semiconductor by polishing-processing while pressing a thin film surface adhered to a surface of a semiconductor substrate having an irregularity pattern to a polishing surface of a polishing tool, and generating relative motion between the polishing tool and the thin film surface, comprising:

forming a surface roughness with a dressing tool on the polishing surface of said polishing tool, during a period before or after said polishing-processing or during the polishing processing, while controlling movement of said dressing tool in a vertical direction by maintaining a cut in amount with respect to said polishing surface.

2. A method for manufacturing a semiconductor according to claim 1, wherein said forming step is performed on each semiconductor substrate.

3. A method for manufacturing a semiconductor according to claim 1, wherein said movement of said dressing tool in a vertical direction is limited in substantially 1 μm.

4. A method for manufacturing a semiconductor according to claim 1, wherein said movement of said dressing tool in a vertical direction is limited between 0.5 and 2 μm.

5. A method for manufacturing a semiconductor by polishing-processing while pressing a thin film surface adhered to a surface of a semiconductor substrate having an irregularity pattern to a polishing surface of a polishing tool, and generating relative motion between the polishing tool and the thin film surface, comprising:

forming a surface roughness with a dressing tool on the polishing surface of said polishing tool before said polishing-processing, while controlling movement of said dressing tool in a vertical direction by maintaining a cut in amount with respect to said polishing surface.

6. A method for manufacturing a semiconductor by polishing-processing while pressing a thin film surface adhered to a surface of a semiconductor substrate having an irregularity pattern to a polishing surface of a polishing tool, and generating relative motion between the polishing tool and the thin film surface comprising:

forming a surface roughness with a dressing tool on the polishing surface of said polishing tool simultaneously with said polishing-processing while controlling movement of said dressing tool in a vertical direction by maintaining a cut in amount with respect to said polishing surface.

* * * * *

UNITED STATES PATENT AND TRADEMARK OFFICE

CERTIFICATE OF CORRECTION

PATENT NO. : 7,166,013 B2
APPLICATION NO. : 11/004991
DATED : January 23, 2007
INVENTOR(S) : Shigeo Moriyama et al.

It is certified that error appears in the above-identified patent and that said Letters Patent is hereby corrected as shown below:

| Column | Line | |
|---|---|---|
| 1 | 56 | After "frequency" insert --.--. |

Signed and Sealed this

Seventeenth Day of April, 2007

JON W. DUDAS
*Director of the United States Patent and Trademark Office*